US011554892B2

(12) United States Patent
Cheong et al.

(10) Patent No.: US 11,554,892 B2
(45) Date of Patent: Jan. 17, 2023

(54) PACKAGING BOX

(71) Applicant: The Procter & Gamble Company, Cincinnati, OH (US)

(72) Inventors: Yuen Sin Cheong, Beijing (CN); Dongpo Huang, Beijing (CN); Gautam Bhattacharjee, Beijing (CN); Zenghui Wang, Guangzhou (CN); Astrid Annette Sheehan, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/230,248

(22) Filed: Apr. 14, 2021

(65) Prior Publication Data

US 2022/0332461 A1 Oct. 20, 2022

(51) Int. Cl.

| | |
|---|---|
| ***B65D 5/54*** | (2006.01) |
| ***B65D 5/02*** | (2006.01) |
| ***B65D 5/468*** | (2006.01) |
| ***B65D 5/10*** | (2006.01) |
| ***B65D 5/42*** | (2006.01) |

(52) U.S. Cl.

CPC ..... *B65D 5/542* (2013.01); *B65D 5/0236* (2013.01); *B65D 5/106* (2013.01); *B65D 5/4212* (2013.01); *B65D 5/4608* (2013.01)

(58) Field of Classification Search

CPC .... B65D 5/542; B65D 5/0236; B65D 5/4608; B65D 5/106; B65D 5/6611; B65D 5/5405; B65D 5/725

USPC ..... 229/206, 200, 222, 238, 109, 123.2, 229/117.13, 240, 925

See application file for complete search history.

(56) References Cited

U.S. PATENT DOCUMENTS 2,788,933 A * 4/1957 Kessler ..... B65D 5/4608 229/940

2,923,454 A 2/1960 Pupke (Continued)

FOREIGN PATENT DOCUMENTS

EP 0780311 A1 * 6/1997

EP 0780311 A1 6/1997

(Continued)

OTHER PUBLICATIONS

PCT Search Report and Written Opinion for PCT/CN2021/081037 dated May 27, 2021, 16 pages.

*Primary Examiner* — Nathan J Newhouse

*Assistant Examiner* — Phillip D Schmidt

(74) *Attorney, Agent, or Firm* — Christian M. Best

(57) ABSTRACT

The present invention relates to a box of one or more absorbent articles, the box comprising pairs of opposed side walls, pairs of opposed top flaps foldably connected to corresponding side walls, pairs of opposed bottom flaps foldably connected to corresponding side walls, and a weakened area defined by an external weakened line at one of first opposed side walls. The weakened area comprises a first section and a second section divided by an internal weakened line, and an adhesive tape having a tape width and a tape end, and covering adjacent edges of the second opposed top flaps to seal top of the box. The adhesive tape extends along a portion of the one of first opposed side walls in such a way that the adhesive tape covers part of the second section so as not to cover the internal weakened line.

19 Claims, 17 Drawing Sheets

(56) References Cited

U.S. PATENT DOCUMENTS

| | | | | | |
|---|---|---|---|---|---|
| 3,302,857 | A * | 2/1967 | Martin | B65D 5/5405 | 229/238 |
| 3,670,949 | A * | 6/1972 | Galanes | B65D 5/4608 | 229/150 |
| 4,361,267 | A | 11/1982 | Wozniacki | | |
| 4,650,112 | A * | 3/1987 | Booth | B65D 5/10 | 229/157 |
| 4,817,796 | A * | 4/1989 | Camillo | B65D 85/04 | 206/408 |
| 6,047,882 | A * | 4/2000 | Sin | B65D 5/0236 | 229/125.32 |
| 6,688,514 | B2 * | 2/2004 | Evans | B65D 5/3621 | 229/109 |
| 8,763,803 | B2 * | 7/2014 | Swart | B65D 5/0005 | 206/592 |
| 9,126,718 | B2 * | 9/2015 | Lewis | B65D 5/4608 | |
| 9,916,399 | B2 * | 3/2018 | Furst | G06F 30/00 | |
| 2007/0063008 | A1 * | 3/2007 | El-Afandi | B65D 5/0236 | 229/125.39 |
| 2019/0135516 | A1 | 5/2019 | Mabrey | | |
| 2021/0214120 | A1 * | 7/2021 | del Real Pena | B31B 50/62 | |

FOREIGN PATENT DOCUMENTS

| | | | | | |
|---|---|---|---|---|---|
| FR | 2795705 | A1 * | 1/2001 | B65D 5/0236 | |
| GB | 2194935 | A * | 3/1988 | B65D 5/0236 | |
| GB | 2194935 | A | 3/1988 | | |
| GB | 2388837 | A * | 11/2003 | B65D 5/0236 | |
| JP | 09240660 | A * | 9/1997 | B65D 5/0236 | |

* cited by examiner

PACKAGING BOX

CROSS REFERENCE TO RELATED APPLICATIONS

This application is a continuation, under 35 U.S.C. § 120, of Patent Application No. PCT/CN2020/0636895.9, filed on Apr. 24, 2020, which is herein incorporated by reference in its entirety.

FIELD OF THE INVENTION

The present invention relates to a box sealed using adhesive tape with an easy open feature, and a blank to make the box.

BACKGROUND OF THE INVENTION

For transport from one location to another, products are often placed in packages. One of the most common packages is a corrugated cardboard container or package.

A package is generally rectangular and comprises four contiguous vertical side surfaces and two pair of flaps, commonly known as the outer and inner pairs of flaps, on both the top and bottom of the package. Each of the flaps is connected to one of the vertical side surfaces, such that when the pairs of outer and inner flaps are folded toward each other and toward the center of the package, the edges of at least the outer flaps meet at or near the center of the top or bottom of the package, effectively creating the top and bottom horizontal surfaces of the package and closing the package. The flaps on the package are typically sealed in place by glue or by adhesive tape. The tape is often applied in a "C-clip" configuration.

The C-clip is so named because a cross-section of the tape along the length of the tape as it is applied to a package is in the shape of the letter "C". Specifically, a C-clip of tape is a continuous length of adhesive tape that is applied to a portion of one vertical side of a package, across the center of one of the horizontal surfaces of the package to seal the abutting outer flaps together and finally to a portion of the opposite vertical side of the package. When the package is closed and sealed with a C-clip of adhesive tape, there are no substantial gaps to allow contaminants to reach the product or products enclosed in the package.

To gain access to products inside, the box needs to be opened. One typical method to remove the tape can involve using a sharp instrument such as a knife to slit the tape. With this method, however, a user may cut and damage the products inside by the knife. Another method is to design a box to have an easy opening feature. U.S. Pat. No. 9,126,718 discloses a box closed using adhesive tape wherein a flap of a wall panel is configured to hingeably open parallel to each other to thereby assist in removing the adhesive tape from the one or more securing panels.

It is desirable to provide a box sealed with an adhesive tape which can be easily open by removing the adhesive tape without use of tools.

It is also desirable to provide a box which can be assembled easily, and resistant against external pressure.

SUMMARY OF THE INVENTION

The present invention relates to a package of one or more articles, the package comprising pairs of opposed side walls; pairs of opposed top flaps foldably connected to corresponding side walls; pairs of opposed bottom flaps foldably connected to corresponding side walls; a weakened area defined by an external weakened line at one side wall, the weakened area comprising a first section and a second section divided by an internal weakened line; and an adhesive tape covering adjacent edges of a pair of opposed top flaps to seal top of the box. The adhesive tape has a tape width and a tape end, and extends along a portion of the one of first opposed side walls in such a way the adhesive tape covers part of the second section so as not to cover the internal weakened line. The internal weakened line is angled about a transversal direction of the box, and does not extend to across the adhesive tape in the width direction of the adhesive tape.

For ease of discussion, the box and the blank will be discussed with reference to the numerals referred to in these Figures. The Figures and detailed description should however not be considered limiting the scope of the claims, unless explicitly indicated otherwise, and the invention disclosed herein is also used in a wide variety of packaging boxes.

BRIEF DESCRIPTION OF THE DRAWINGS

In the drawings, like numerals or other designations designate like features throughout the views.

DETAILED DESCRIPTION OF THE INVENTION

Various non-limiting forms of the present disclosure will now be described to provide an overall understanding of the principles of the structure, function, manufacture, and use of a box for packaging articles. One or more examples of these non-limiting embodiments are illustrated in the accompanying drawings. Those ordinary skilled in the art will understand that the boxes described herein and illustrated in the accompanying drawings are non-limiting example forms and that the scope of the various non-limiting forms of the present disclosure are defined solely by the claims. The features illustrated or described in connection with one non-limiting form may be combined with the features of other non-limiting forms. Such modifications and variations are intended to be included within the scope of the present disclosure.

As used herein the "longitudinal", "transversal", "top", "bottom" and the like, when used to describe a box or a blank, relate to a box placed in a carrying position with the bottom part facing downwards and the top part facing upwards, such as e.g. shown in the figures.

Box

The present invention is directed to a box comprising a top, a bottom and pairs of opposed parallel side walls. Each of the top and the bottom of the box is closed by top and bottom flaps, respectively. Each of flaps is foldably joined along a folding line at one edge to a top or a bottom edge of a corresponding side wall. The box further comprises a weakened area formed at one side wall, the weakened area being defined by an external weakened line. The weakened area comprises two sections divided by an internal weakened line.

Figure 1:
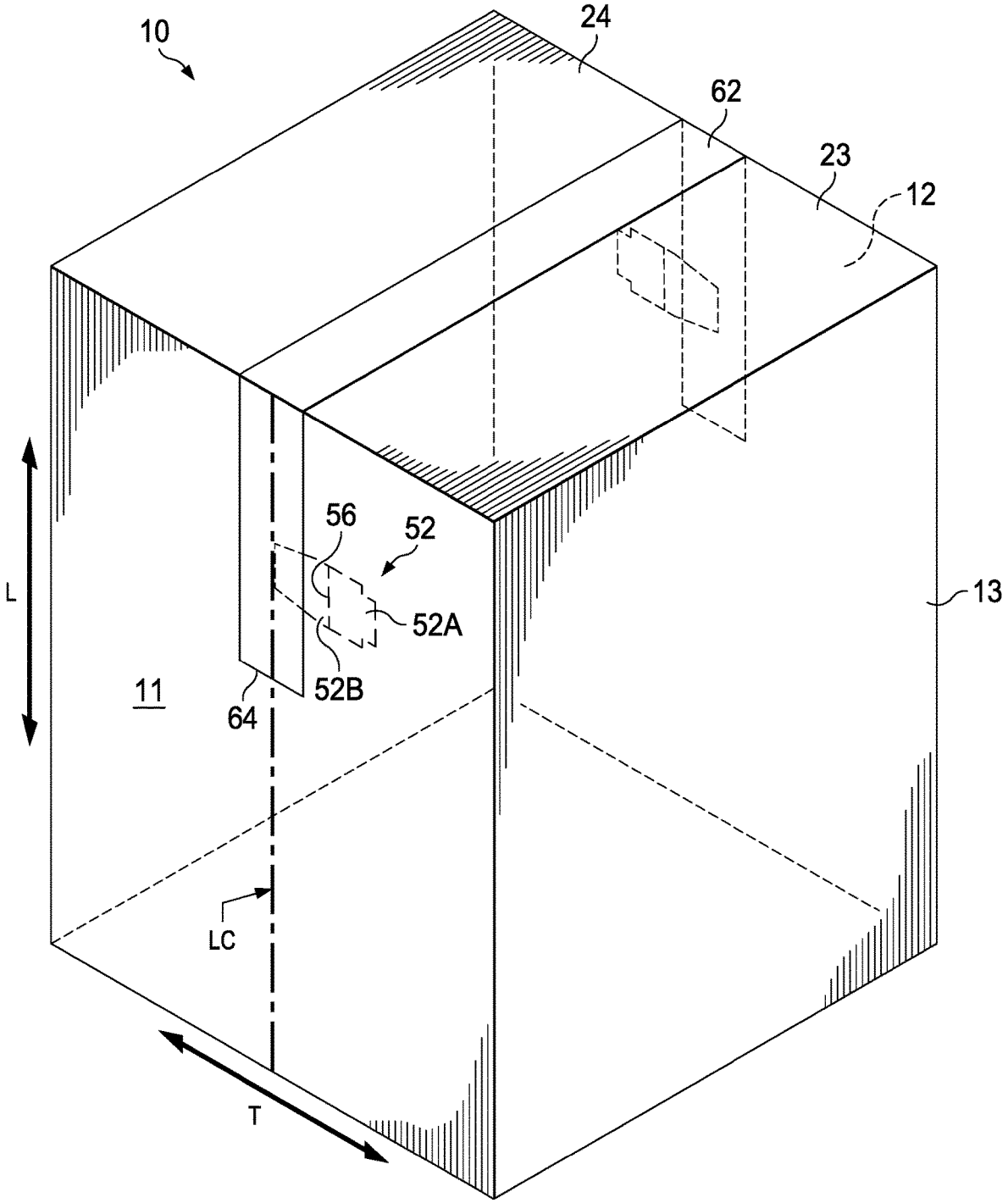
FIG. 1 is a top perspective view of a box according to the present invention.
Figure 7:
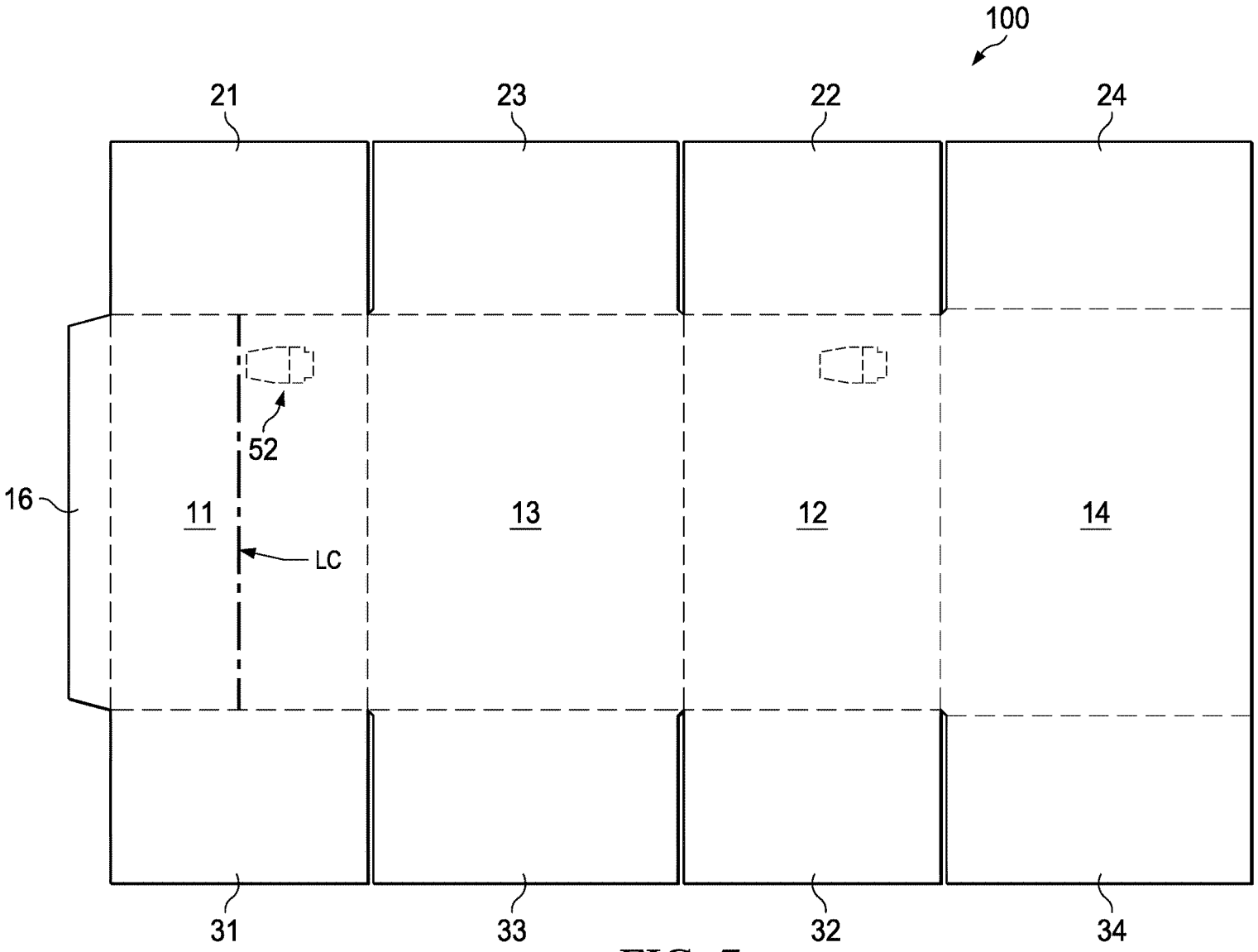
FIG. 7 is a plan view of a blank of the present invention used to form the box in FIG. 1.

Referring to FIGS. 1 and 7, box 10 of the present invention comprises a pair of first opposed side walls 11 and 12; a pair of second opposed side walls 13 and 14; a pair of first opposed top flaps 21 and 22 foldably connected to the pair of first opposed side walls 11 and 12; a pair of second opposed top flaps 23 and 24 foldably connected to the pair of second opposed side walls 13 and 14; a pair of first opposed bottom flaps 31 and 32 foldably connected to the pair of first opposed side walls 11 and 12; a pair of second opposed bottom flaps 33 and 34 foldably connected to the pair of second opposed side walls 13 and 14. The box 10 has a longitudinal direction L and a transversal direction T.

The box 10 further comprises a weakened area 52 formed at one of first side walls 11 and 12, and an adhesive tape 62.

Figure 2:
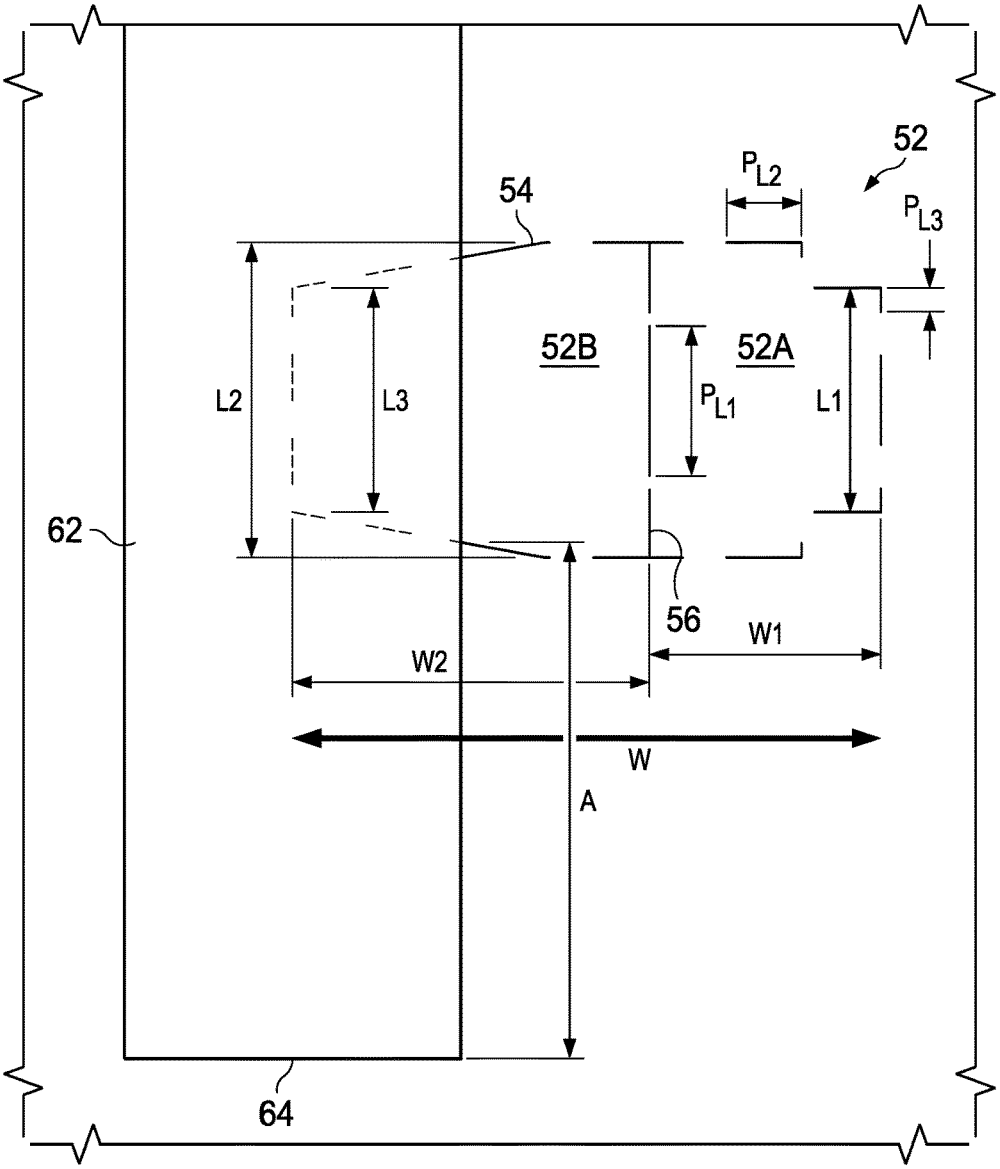
FIG. 2 is a detailed view of a weakened area and an adhesive tape in a side wall of the box in FIG. 1.
Figure 3:
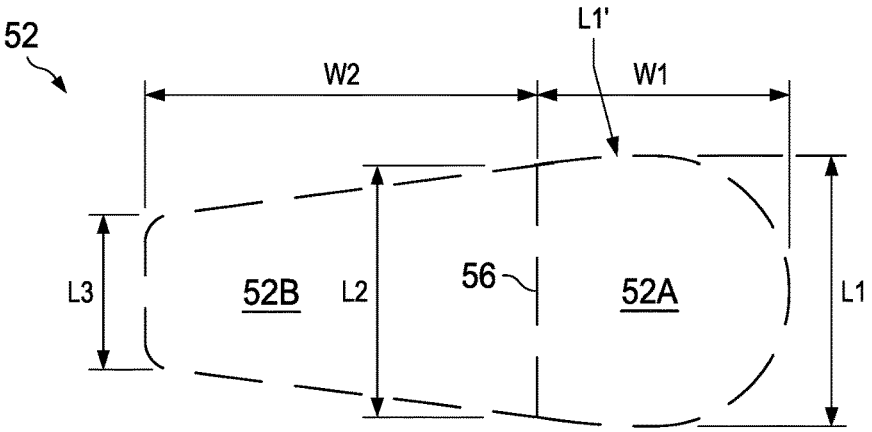
FIG. 3 is another exemplary weakened area.

Referring to FIGS. 2 and 3 showing configurations of exemplary weakened area 52, the weakened area 52 defined by an external weakened line 54 comprises two sections, the first section 52A and the second section 52B, divided by an internal weakened line 56. The external weakened line 54 and the internal weakened line 56 each may be any weakened line such as a compressed line, a perforated line comprising a plurality of perforations, and a combination thereof. The perforation may be in a circle, oval, or any other shape. The perforation may be a slit.

At the time of package opening, section 52A of the weakened area 52 is pushed by applying a force for example by a finger, whereby the first section 52A is pushed inward. When the first section 52A is pushed inward, an opening is formed, and a finger is inserted into the opening to grip the second section 52B, and pull the second section 52B outward. When the second section 52B is pulled outward, an end part of the adhesive tape 62 is also pulled outward together with the second section 52B, thereby removing the adhesive tape from the box by continuously pulling the adhesive tape 62 from the box 10. External weakened line 54 is distanced from junctions of side walls and top flaps or side walls and bottom flaps, for example the junction between a first side wall where the weakened area is formed and a first top flap connected to the first side wall, so as not to compromise the structural integrity at this location.

In addition, an opening corresponding to the first section 52A and the second section 52B which remains after a tape is removed may serve as a handle that allows a user to conveniently carry the box around.

Still referring to FIG. 2 and FIG. 3, the first section 52A has a first section width W1, and an outboard edge with a length L1. The first section width W1 and the outboard edge length L1 may be adjusted to properly accommodate one or two fingers. The internal weakened line 56 has an internal weakened line length L2. The internal weakened line length L2 may be adjusted to properly accommodate a thumb breadth of an adult, for example, about from 2 cm to about 4 cm, or about form 2 cm to about 3 cm. The internal weakened line length L2 may be no shorter than the first section width W1. With a configuration of the weakened area 52 where L2 is no shorter than W1, the shape of first section 52A invites a finger orientation and alignment with the feature 52 that is best suited for applying force on first section 52A of feature 52 (such as poking through or pushing inward and bending a flap) without sacrificing comfort. In one embodiment, the internal weakened line length L2 is shorter than the outboard edge length L1 of the first section 52A. This may create an optimum shape that is widest where the finger incision occurs to facilitate insertion and minimize restriction of movement, but smallest where the second section 52B overlaps the tape to minimize the amount of perforation that the user must break concurrent with lifting the tape 62.

The second section 52B has a second section width W2, and an inboard edge with a length L3. A second section 52B with a tapered configuration such as when L3 is shorter than L2 may reduce the effort associated with breaking the external weakened line 54 at the junction with the tape 62 where consumers must also overcome the adhesive force of the tape 62.

Figure 4A:
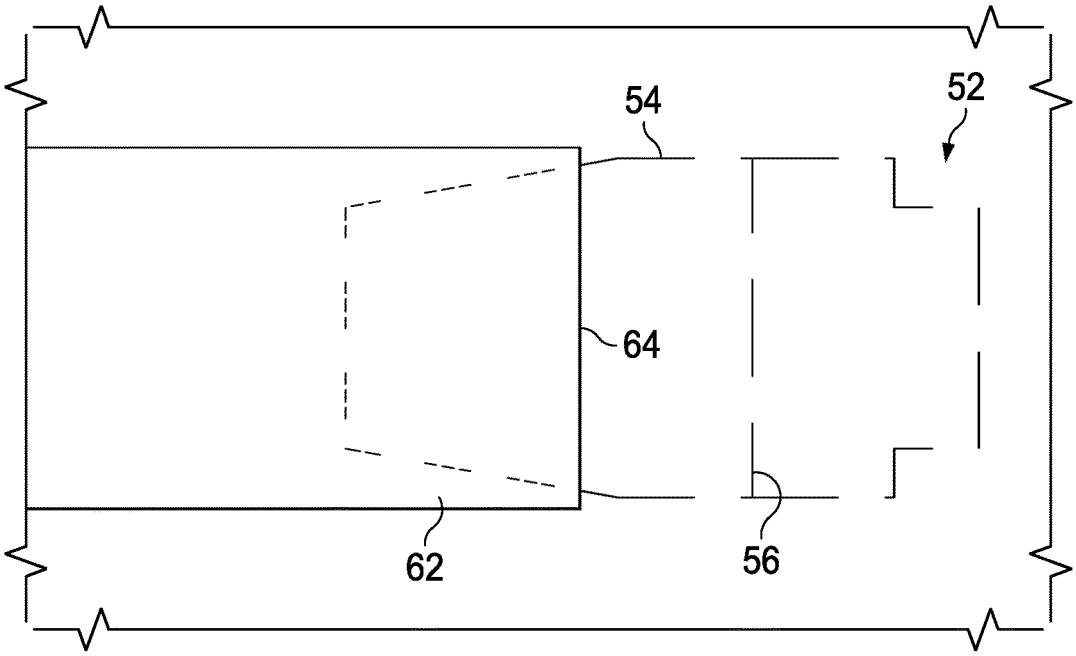
FIG. 4A is an exemplary configuration of a weakened area and an adhesive tape in a side wall of a box.
Figure 4B:
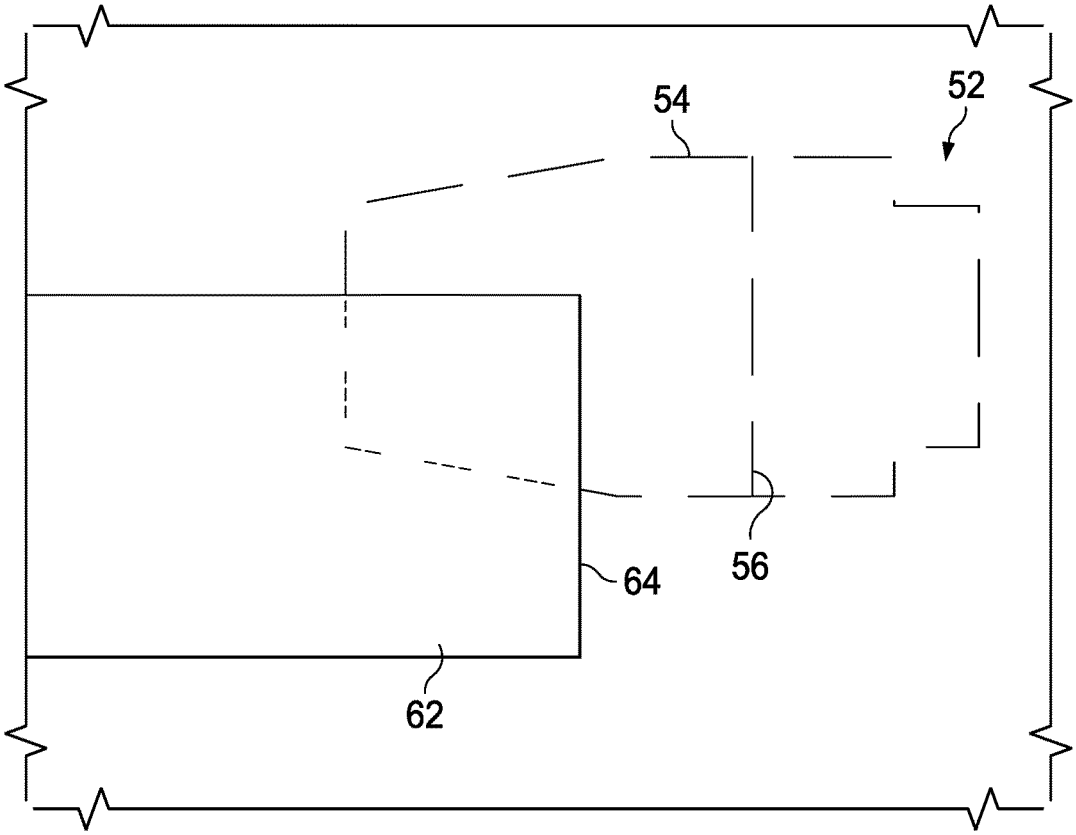
FIG. 4B is another exemplary configuration of a weakened area and an adhesive tape in a side wall of a box.
Figure 4C:
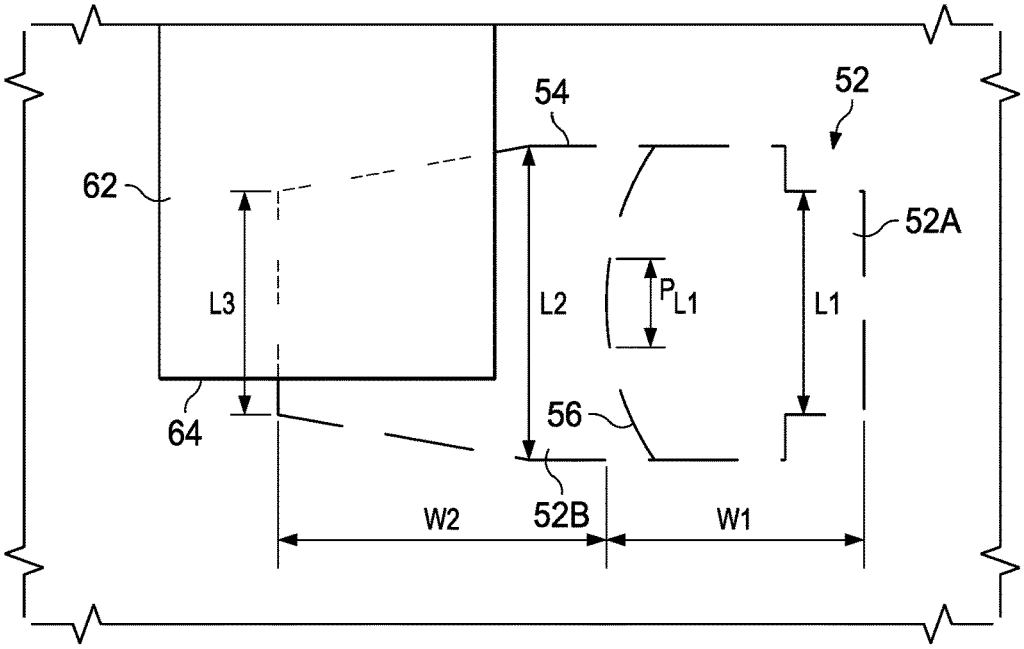
FIG. 4C is another exemplary configuration of a weakened area and an adhesive tape in a side wall of a box.

The internal weakened line 56 may be a straight line as shown in FIG. 2, or it may be a curved line as shown in FIG. 4C.

Figure 4D:
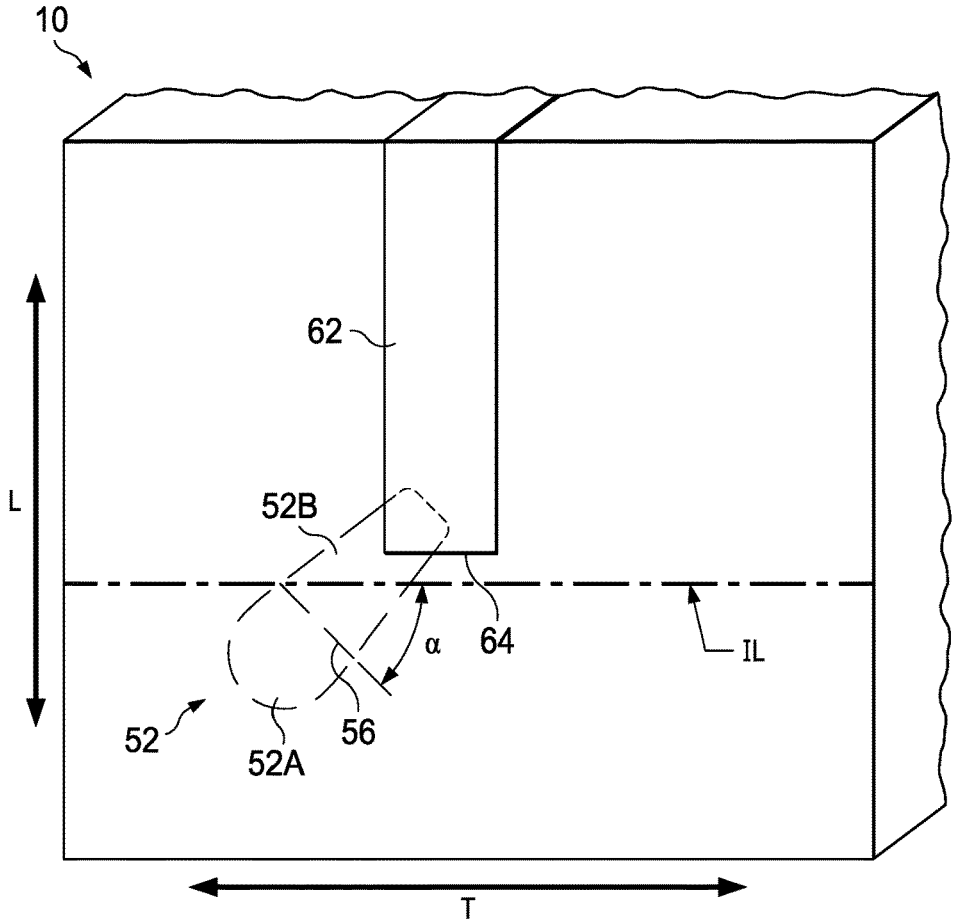
FIG. 4D is another exemplary configuration of a weakened area and an adhesive tape in a side wall of a box.

The internal weakened line 56 is angled about the transversal direction T of box 10 Referring to FIG. 4D, with the internal weakened line 56 being angled about the transversal direction T of the box 10, it intends to mean an angle $\alpha$ determined by an imaginary line IL parallel to the transversal direction T of the box 10 and the internal weakened line 56 is greater than 0°, and equal to or less than 90°. With the internal weakened line 56 being angled about the transversal direction T of box 10, it intends to mean not to include a case where the internal weakened line 56 is parallel to the transversal direction T of the box 10.

The angle $\alpha$ may be in the range of from about 10° to about 90°, or about 45° to about 90°. In one embodiment, the angle $\alpha$ may be about 90°, so that the internal weakened line 56 is substantially parallel to the longitudinal direction L of the box 10 as indicated in FIG. 1. With the feature of angled weakened area 52, it may exercise a balance between good ergonomics or natural finger orientation and lift force utilization. Without wishing to be bound by theory, the most efficient use of force is expected to occur when the force is applied directly in line with the lifting direction which is dictated by the tape 62. That perfect alignment between lift force and the tape 62 comes at the expense of a cumbersome wrist posture or very poor ergonomics so a balance is important. Discomfort may not be easily compensated for and if excessive it may even discourage the use of the feature altogether. Therefore, incrementally larger angles may be preferred, in particular at least 45° or larger because these configurations shift the balance more in favor of comfort.

Referring to FIG. 4C, when the internal weakened line 56 is not linear, a direction of the internal weakened line 56 is determine by a line generated by connecting two junctions of the internal weakened line 56 and the external weakened line 54.

The internal weakened line 56 may not encounter the longitudinal centerline LC of the side wall where the weakened area 52 is placed, as shown in FIG. 1 and FIG. 4D.

When the internal weakened line 56 comprises a perforation, the internal weakened line 56 comprises a perforation having a length different from lengths of perforations constituting the external weakened line 54. In one embodiment, referring to FIG. 2, the internal weakened line 56 comprises a perforation having a length $P_{L1}$ longer than perforations such as $P_{L2}$ and $P_{L3}$ constituting the external weakened line 54. Perforation(s) having a long length in an internal weakened line 56 may serve as visual cues indicating the internal perforating line is an initiating point to break.

The box of the present invention further comprises an adhesive tape 62 covering adjacent edges of opposed top flaps to seal top of the box. Referring to FIGS. 1 and 7, the adhesive tape 62 covers adjacent edges of the second top flaps 23 and 24 to seal top of the box 10, extends along a portion of a first side wall 11. Referring to FIGS. 2, 4C, 4D showing a configurations of a weakened area 52 and an adhesive tape 62, the adhesive tape 62 extends so as to partly traverse the second section 52B in the transversal direction T. This may ensure that the tape does not cover the internal weakened line 56 to reduce the risk of tape snapping when users break the weakened line. The internal weakened line 56 may comprise a perforation. With an internal weakened line 56 which is not covered by adhesive tape 62, when an opening is formed by pushing the weakened area 52, particularly the first section 52A, the tape end 64 or a side edge of the tape 62 is hard to be fractured or snapped. When the internal weakened line 56 extends along a longitudinal direction of a box 10, referring to FIG. 2, a tape end 64 may be in a position lower than the weakened area 52. The tape end 64 may be in a position within the weakened area 52 in a longitudinal direction as shown in FIG. 4C. The length of the adhesive tape 62 overlapping the weakened area may be shorter than the length of the internal weakened line L2. Referring to FIG. 2, the length A from a bottommost point of the weakened area 52 to the end 64 of the adhesive tape 62 may be no longer than about 60 mm, or no longer than about 50 mm or no longer than about 40 mm Having such a length A may ensure a user can easily lift off the tape end in one continuous motion by griping and drawing out the second section 52B.

The box of the present invention may have a weakened area 52 in each of a pair of opposite first side walls. In one embodiment, referring to FIGS. 1 and 7, the box 10 comprises a weakened area 52 in each of first side walls 11 and 12, and each end of the adhesive tape 62 extends along a portion of each first opposed side wall 11, 12 in such a way the adhesive tape 62 covers part of section 52B of a weakened area 52 so as not to cover the internal weakened line 56 of weakened area 52, allowing the tape 62 to be removed from either ends or both ends.

The box of the present invention may have at least two weakened areas 52 in at least one of first side walls to assist in removing the adhesive tape 62 from top flaps and bottom flaps. In one embodiment, referring to FIGS. 5 and 8, the box 10 comprises two weakened areas 52 in each of the first side walls 11 and 12. One adhesive tape 62 covers adjacent edges of the second top flaps 23 and 24 to seal top of the box 10 and extends along a portion of a first side wall 11 and a portion of a first side wall 12. Another adhesive tape 62 covers adjacent edges of the second bottom flaps 33 and 34 to seal bottom of the box and extends along a portion of a first side wall 11 and a portion of a first side wall 12. The adhesive tape 62 covers part of section 52B of a weakened area 52 so as not to cover the internal weakened line 56 of weakened area 52.

It will be appreciated that the above described arrangements allow the tape 62 to be removed from the box 10 used to secure each of the top and bottom of the box, which in turn allows the box to be returned to a flat pack arrangement, for example to allow a box to be easily stored or transported after use. With a tape, a synthetic plastic, being separated from the box, this makes the box ready to be recycled and thus, more sustainable.

In one embodiment, the box of the present invention is in a rectangular shape having four side walls, referring to FIG. 1.

Figure 5:
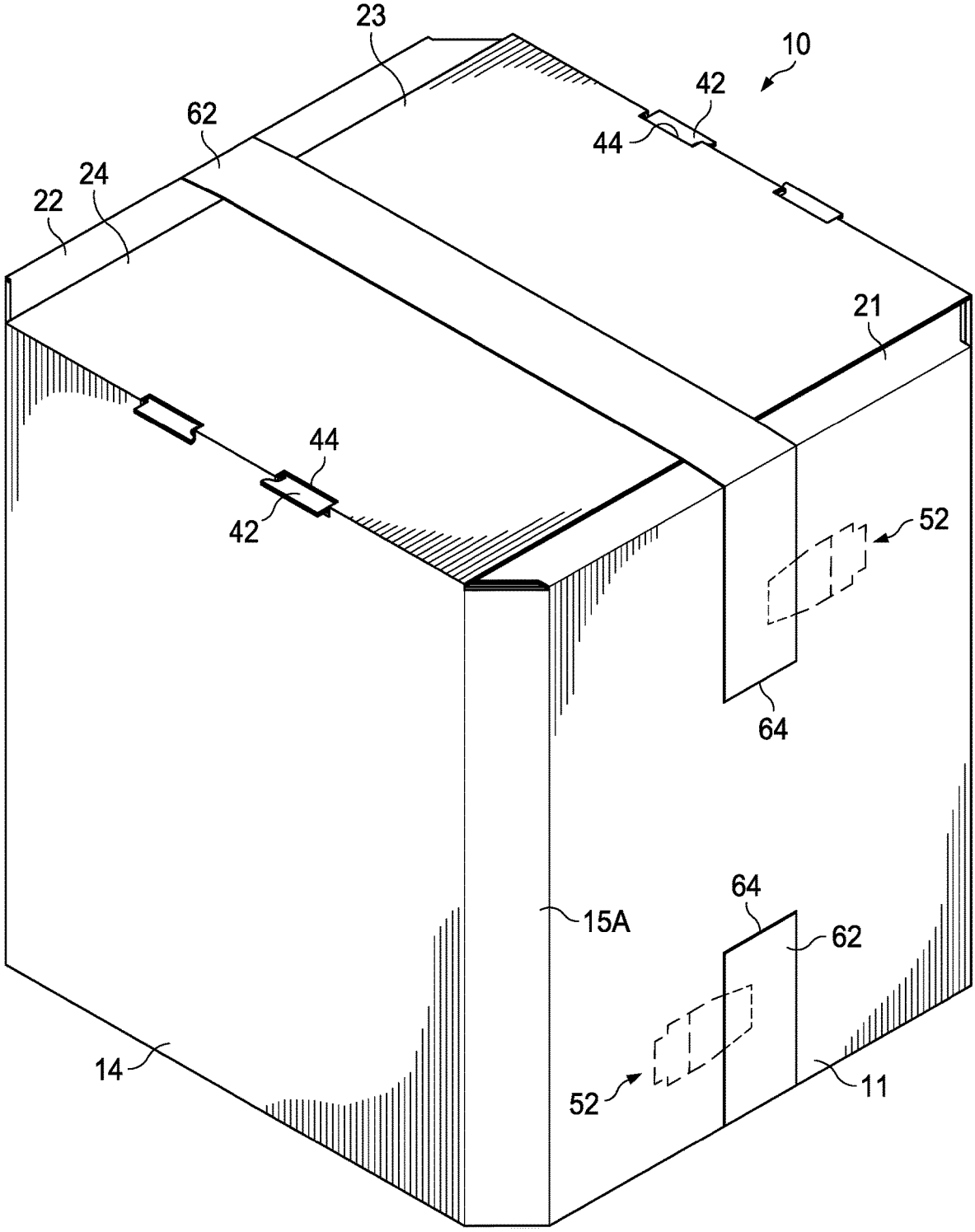
FIG. 5 is a top perspective view of another box according to the present invention.

In another embodiment, the box of the present invention is in an octagonal shape having pairs of parallel side walls and four interposed diagonal corner panels, referring to FIG. 5. The height to width ratio of the box may vary depending on the size of the articles contained within and this may render the general shape of the box to be columnar, rectangular or cuboidal.

Figure 8:
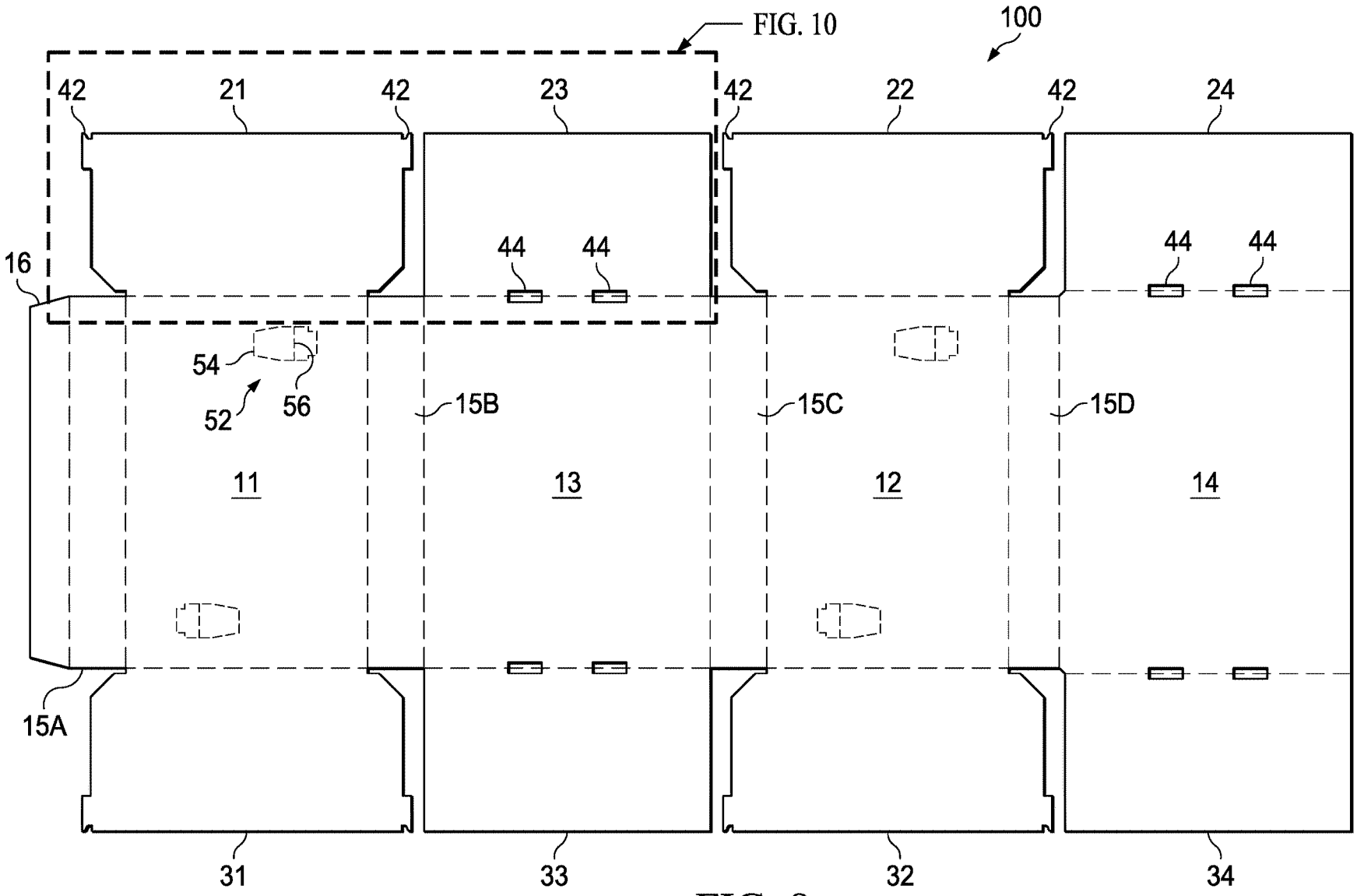
FIG. 8 is a plan view of a blank of the present invention used to form the box in FIG. 5.
Figure 10:
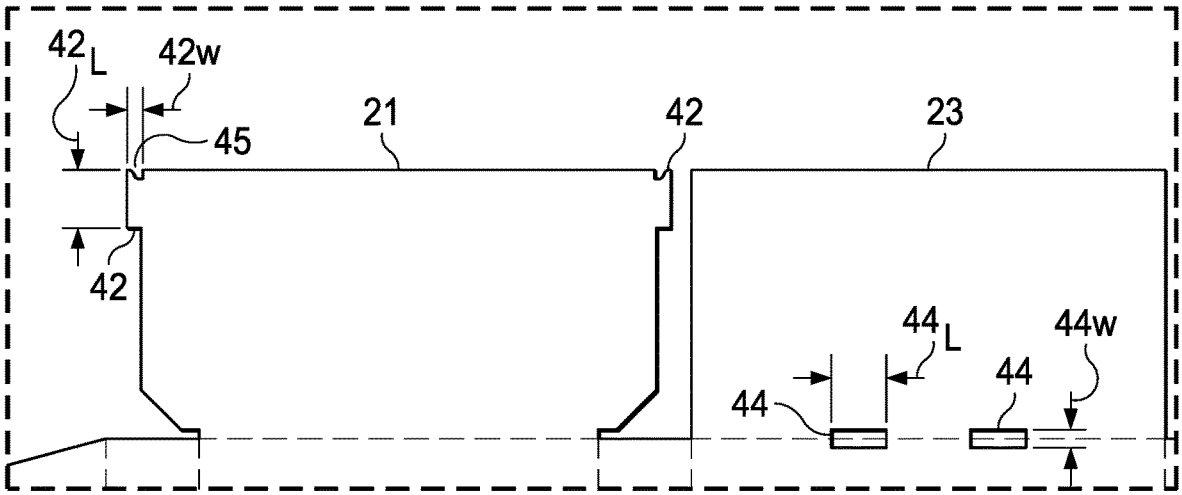
FIG. 10 is a detailed view of a protrusion and a slot in the blank in FIG. 8.

The box of the present invention may further comprise a protrusion on a side edge of a first top flap, and a slot at a line joining a second top flap and a side wall, the protrusion and the slot engaging with each other. Referring to FIGS. 5 and 8, at least one of first top flaps 21 and 22 comprises at least one protrusion 42 projected from a side edge thereof. At least one of the first top flaps 21 and 22 may comprises at least one protrusion 42 in each side edge thereof. At least one of the first top flaps 21 and 22 may have at least one protrusion 42 in at least one side edge. The protrusion 42 may be located in any part of the side edge of the first top flap. In one embodiment, the protrusion is located outermost part of the side edge of the first top flap as shown in FIGS. 5 and 8. The protrusion may be in various shapes. In one embodiment, referring to FIG. 10, the protrusion 42 comprises a hook-shaped end. The protrusion 42 may have a hook-shaped end on an outer end thereof as shown in FIG. 10. A hook-shaped end herein intends to mean that the protrusion 42 has an end part having a concave portion 45 referring to FIG. 10. The slot 44 may slightly extend to the top flap and/or the side wall.

Figure 6:
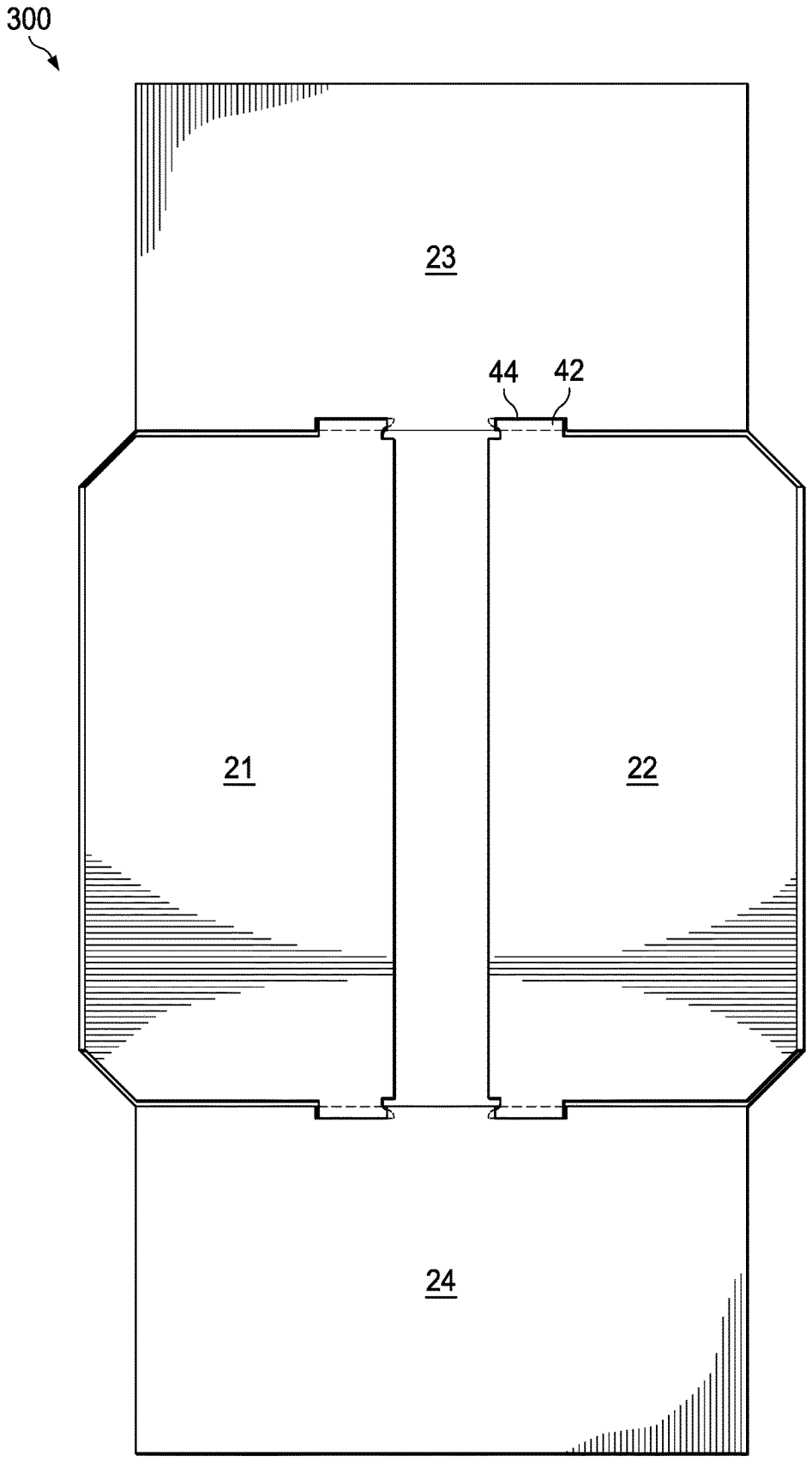
FIG. 6 is a top view of an erected box to make the box in FIG. 5.

Referring to FIG. 6, upon folding the first top flaps 21 and 22 inwardly and engagement of protrusions 42 with corresponding slots 44, the first side walls 11 and 12 tend to move inwards which may cause the protrusion to slipping out of the slot. In order to avoid the protrusion from slipping out of the slot, a hook-shaped feature ensures that the protrusion stays engaged with the slot, and a box is properly set up. Referring to FIG. 10, protrusion 42 has a protrusion length $\mathbf{42}_L$ and a protrusion thickness (not indicated in drawings), and slot 44 has a slot length $\mathbf{44}_L$ and a slot width $\mathbf{44}_W$. The slot length $\mathbf{44}_L$ may be in the range of 95-105% of the protrusion length $\mathbf{42}_L$. The slot width $\mathbf{44}_W$ may be in the range of 140-180% of the protrusion thickness. These ranges of a slot length and a slot width may allow one-step insertion of a protrusion into its corresponding slot and speeding up manual box set up. If a slot length or a slot width is too wide, unnecessary open space remains in the slot even after the slot is engaged with a protrusion which may cause a dust or insect contamination of products inside the box.

Figure 13A:
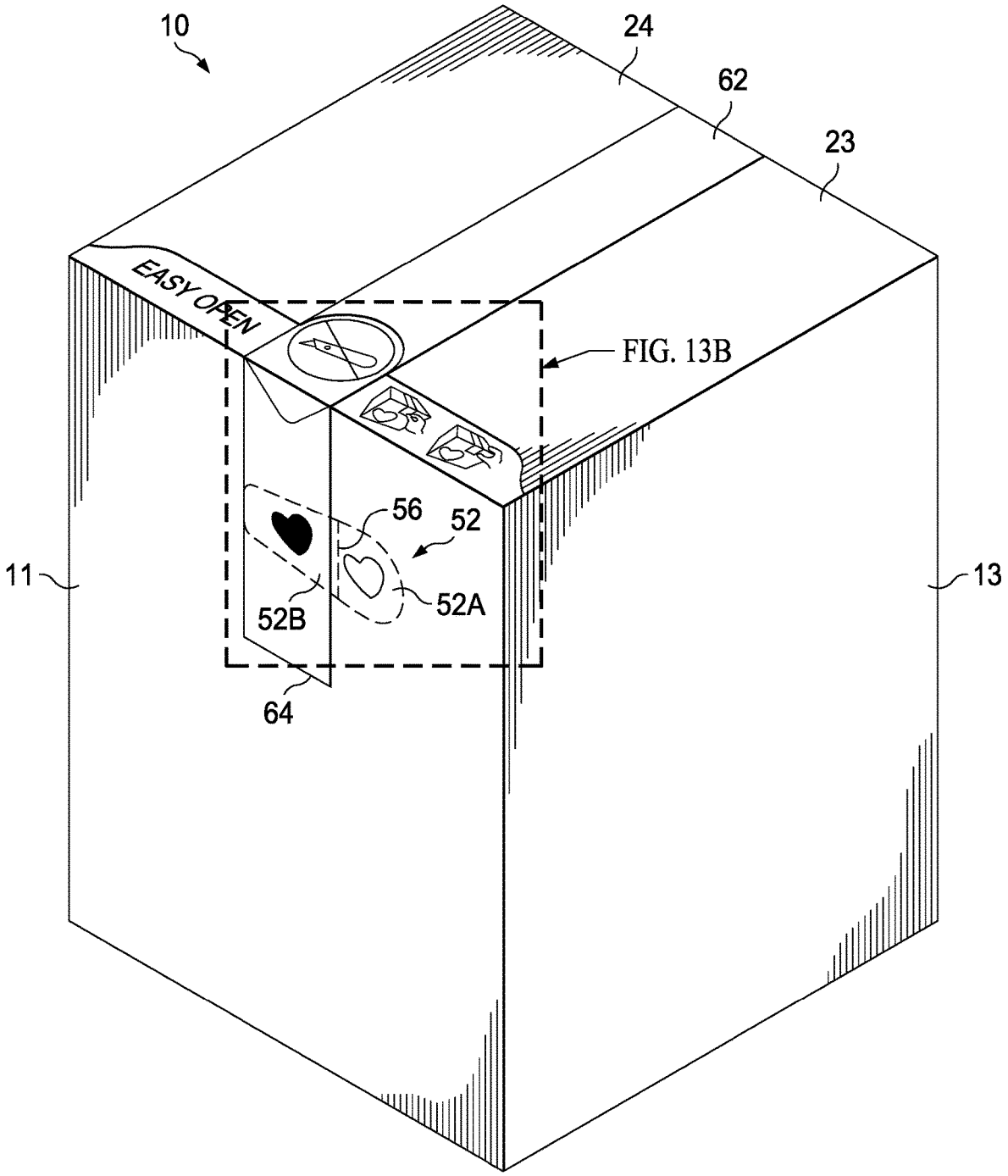
FIG. 13A is a top perspective view of another box according to the present invention.
Figure 13B:
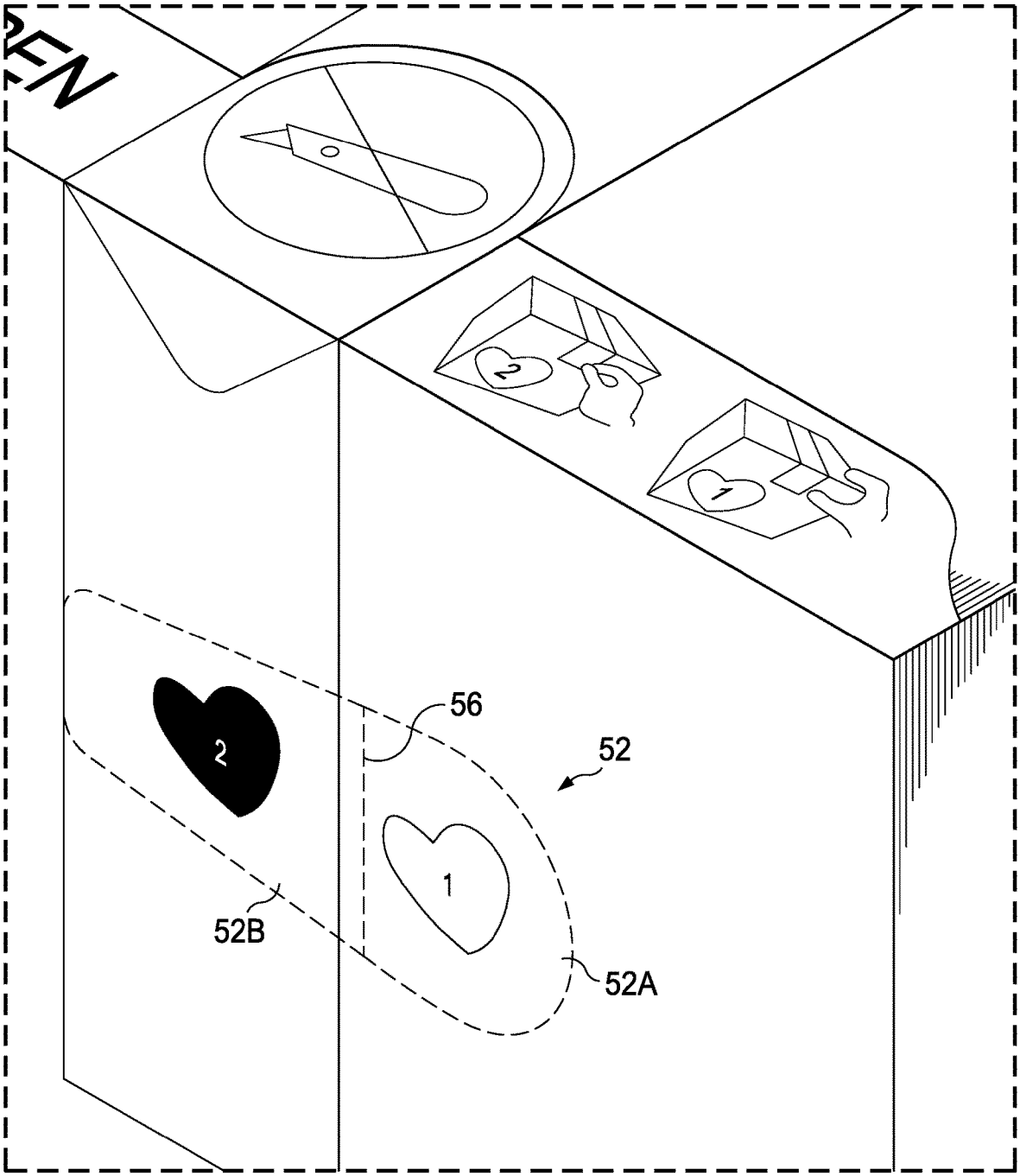
FIG. 13 Bis a detailed view of parts having several indicia in the box in FIG. 13A.

Referring to FIGS. 13A and 13B, it may be desired to provide one or more indicia on the package that visibly, tactilely and/or verbally identify the presence of the weakened area 52, and/or the location of the weakened area 52 or part of the weakened area 52 such as the internal weakened line 56. The one or more indicia may include, but are not limited to, an imprinted marking of a color that visibly contrasts with surrounding package color; tactilely perceivable indicia; verbal indicia; other graphic indicia; alphabetical letter; numerical number; or any combination thereof.

The package may include verbal or graphic indicia that guide or encourage the consumer to use the weakened area 52 for example, to push the first section 52A to open it by applying a force for example by a finger, whereby the first section 52A is pushed inward. Additionally, or alternatively, commercial artwork, graphics, and verbal information printed onto the package may be configured in some examples to have an upright appearance.

In one embodiment, the first section 52A and the second section 52B have color, text, and/or icons so as to differentiate the first section 52A and the second section 52B. Referring to FIGS. 13A and 13B, the heart with number 1 in the first section 52A and the heart with number 2 in the second section 52B may give guidance to the consumers to push the first section 52A first to open it, and then grip and draw out the second section 52B to pull the tape 62 together with the second section 52B.

Other characteristics of the indicia can vary. For example, the graphic indicia can have varying color, hue, and/or dimensions. And the tactilely perceivable indicia can have varying dimensions (e.g., emboss depth), intensity, frequency or the like. Such characteristics can vary as step changes or gradually like in a gradient pattern.

The box according to the present application may have no substantial gaps, except perforations in the weakened area, if any to allow contaminants to reach the product or products enclosed in the package.

The box may have one or more (e.g. two) handles to enable convenient transport. This may be especially useful for relatively large boxes and/or boxes containing relatively heavy items.

Figure 12:
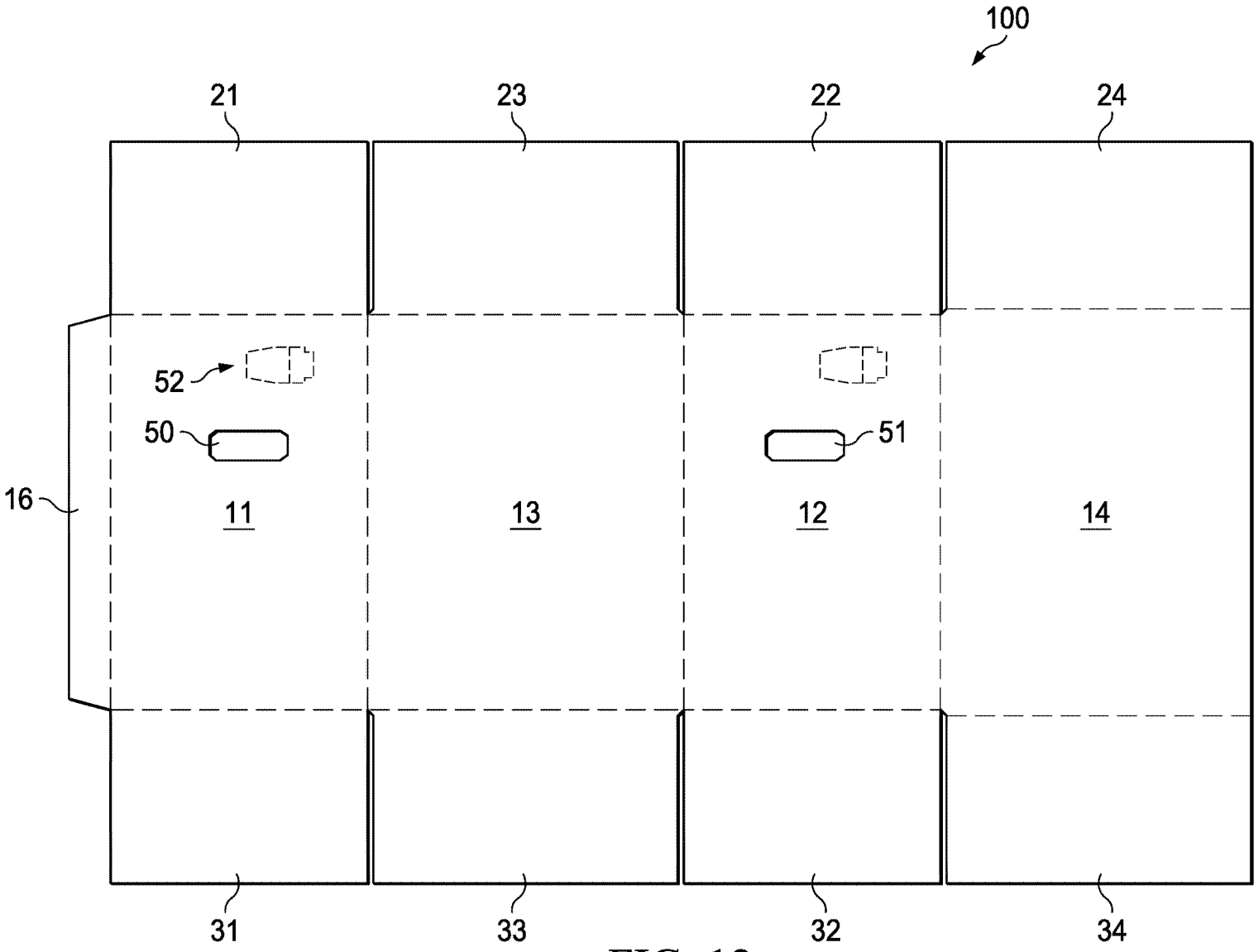
FIG. 12 is a plan view of a blank to form another box according to the present invention.

A first handle 50 may be provided in one first side wall 11 and a first handle 51 may be provided in the other first side wall 12, as exemplified in FIG. 12. The handles may be provided as cut-out sections to allow gripping the box by sliding one or more fingers of one hand through the first cut-out sections and sliding one or more fingers of the other hand through the second cut-out section. The cut-out is thus desirably large enough to allow one or more fingers to conveniently slide through.

Alternatively or in addition to the cut-out section provided in the first side walls 11 and 12, as described in the previous paragraph, cut-out sections may be provided in the second side walls 13 and 14.

Figure 14A:
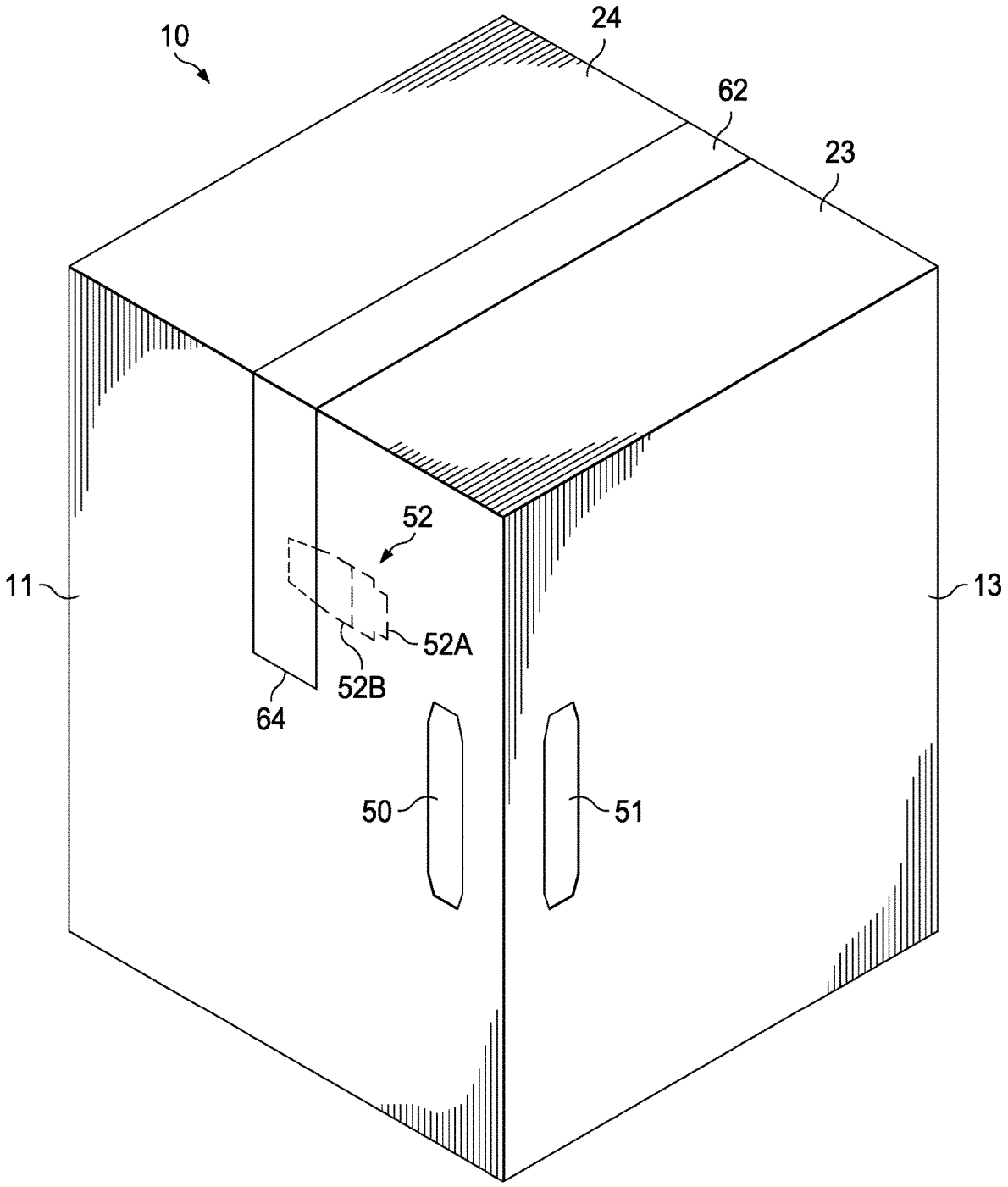
FIG. 14A—FIG. 14C are top perspective views of other boxes according to the present invention.

Alternatively or in addition, as shown in FIG. 14A, a first handle 50, cut-out section 50 in this case, may be provided in a first side wall 11 and a second handle 51, cut-out section 51 in this case, may be provided in a second side wall 13. Both cut-out sections may be adjacent to the vertical fold line between the first side wall 11 and the second side wall 13. A person may slide one or more fingers of one hand through both cut-out sections, thus basically gripping the box around the corner formed at the vertical fold line between the first side wall 11 and the second side wall 13. By doing so, the box can be gripped and carried with one hand only. For enabling convenient gripping, the box by sliding one or more fingers of one hand through both cut-out sections, the cut-out sections should be provided at an appropriate distance away from the vertical fold line between the first side wall 11 and the second side wall 13. For example, each cut-out section should be from 20 mm to 40 mm, or from 25 mm to 35 mm away from the vertical fold line. By providing the cut-out sections too close to the vertical fold line may decrease the stabilize (stability) of the box, whereas providing the cut-out sections too far away from the vertical fold line may make it difficult to properly grip the box. The cut-out sections may have a rectangular, circular, elliptical shape or any appropriate shape.

Alternatively or in addition to the handle provided in the first side wall 11 and in the second side wall 13, as described in the previous paragraph, a handle 50 and/or 51, cut-out section in this case, may be provided in another first side wall 12 and another second side wall 14.

Figure 14B:
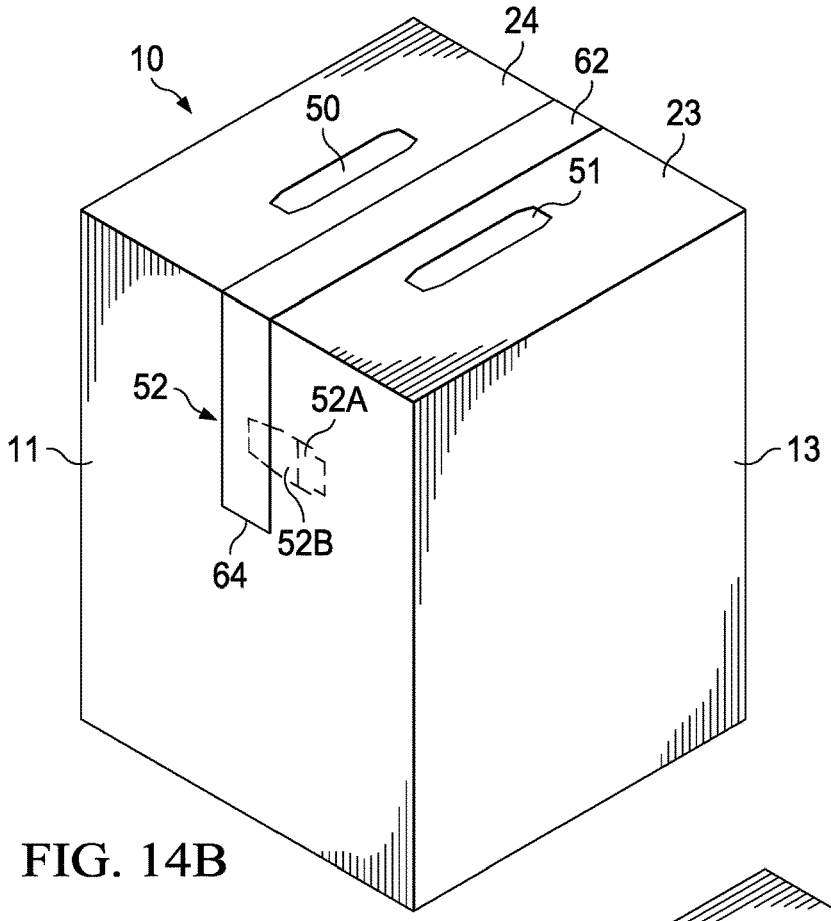
Figure 14C:
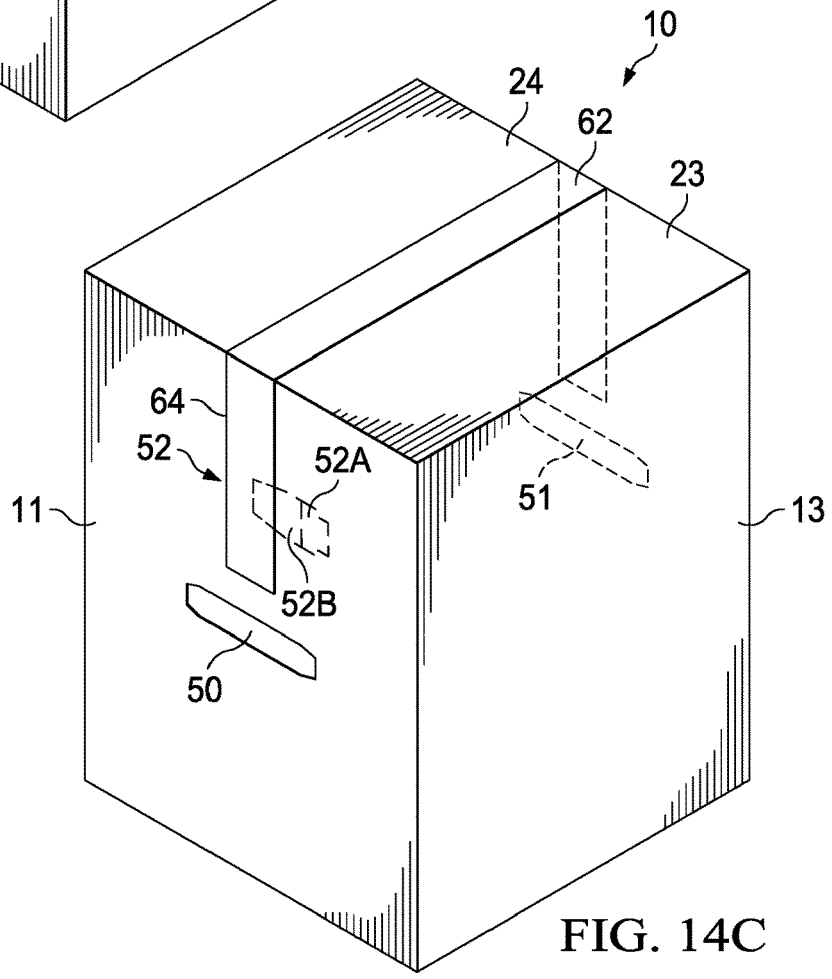

FIGS. 14B and 14C are other examples of boxes according to the present invention having handles 50 and/or 51.

Figure 15A:
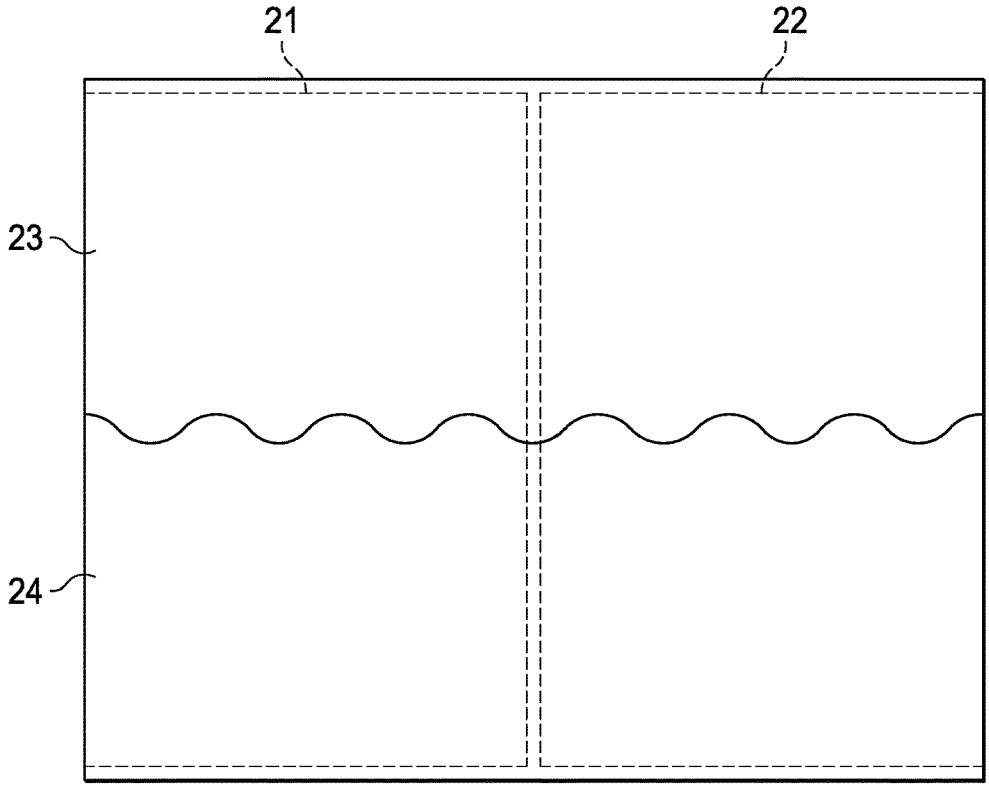
FIG. 15A and FIG. 15B are exemplary shaped top flaps.
Figure 15B:
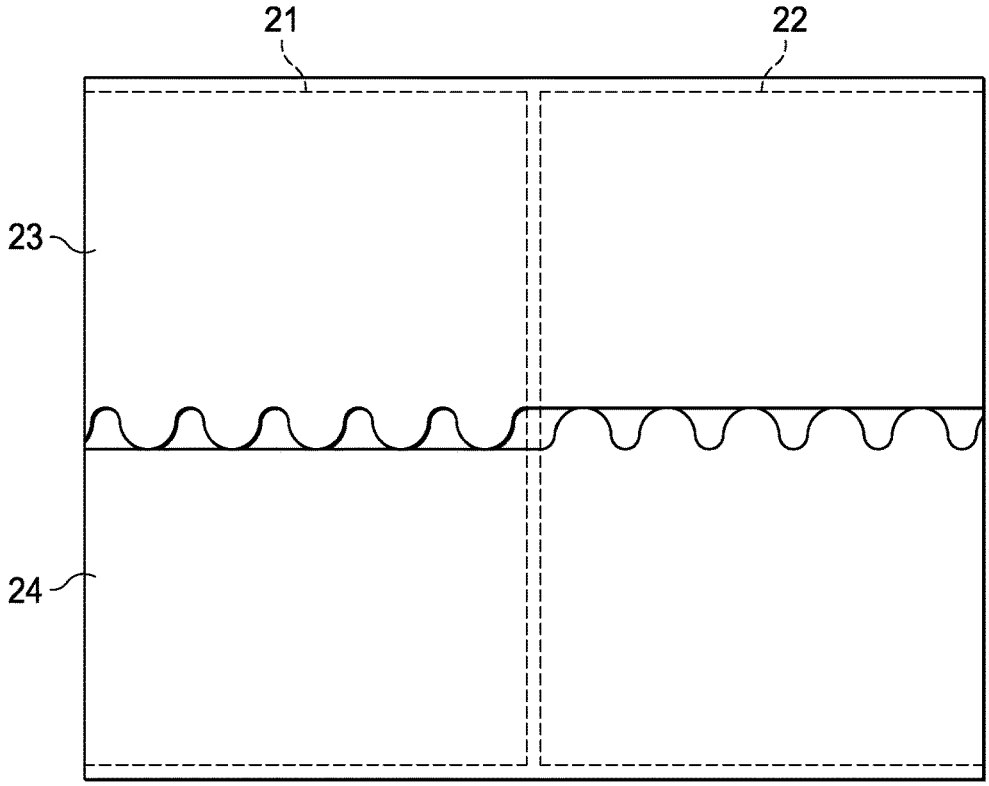

The box of the present invention, referring to FIGS. 15A and 15B, may have a pair of top flaps 21 and 22 having shaped edges. The edges where the top outer flaps meet each other and sealed by a tape are conventionally straight to allow users to conveniently cut along between the edges to open the box. With enabling to open a box by peeling tape instead of cutting, outer flap edges of arbitrary shape may be designed to enhance visual aesthetics of the box.

The box of the invention may comprise corrugated paperboard having adequate strength to withstand the weight of the contents and to enable multiple containers to be stacked on top of one another.

The box of the invention may contain any product which is appropriate to be packaged using the box. In one embodiment, the box of the present invention contains a plurality of absorbent articles.

In some embodiments, at least two of the package, the adhesive tape and the article have printed artwork having at least one common element.

The present invention is also directed to a blank for forming a packaging box of the present invention.

Figure 11:
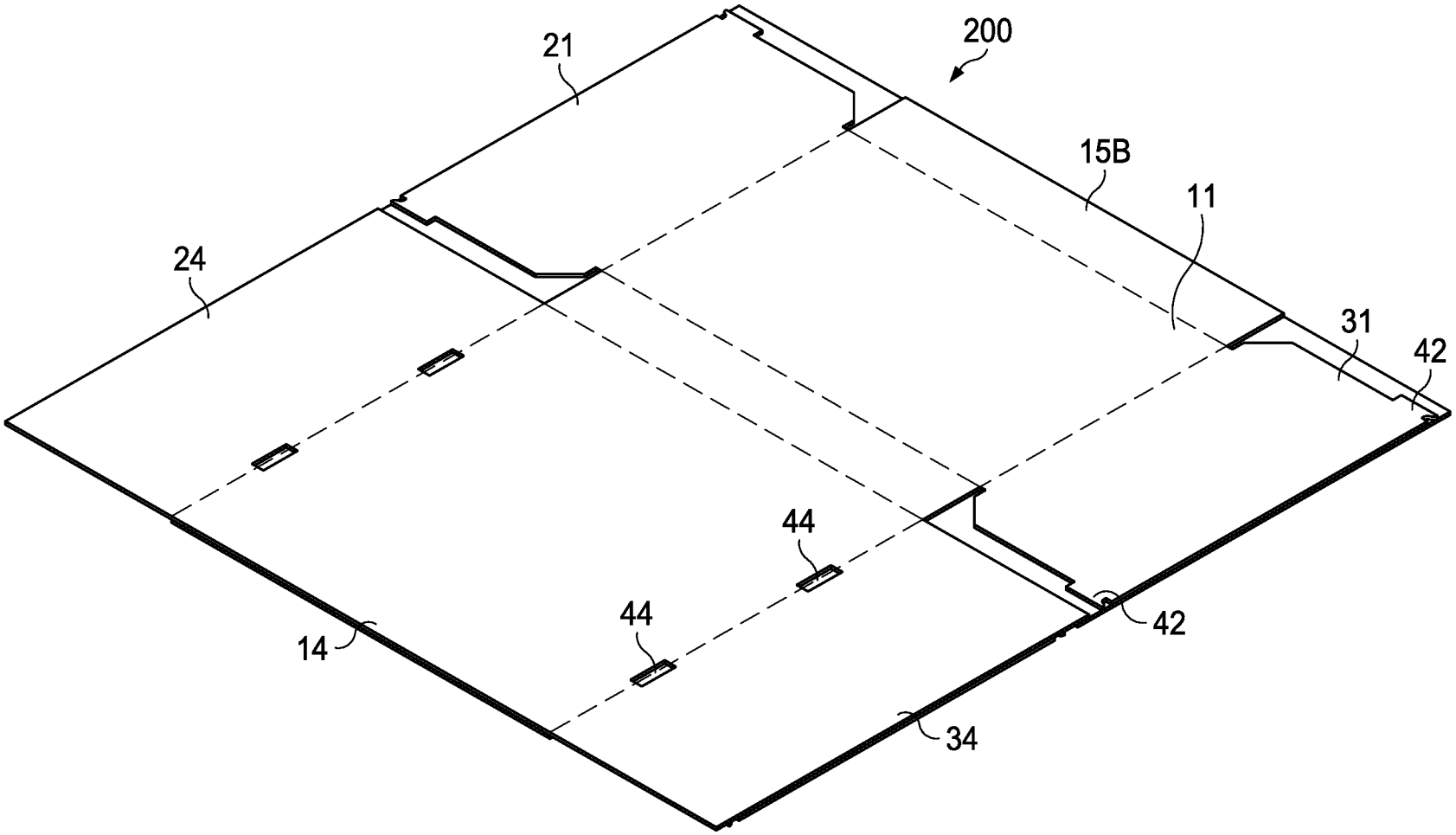
FIG. 11 is a top plan view of the box in FIG. 5 in a folded flat pact condition.

Referring to FIG. 7, blank 100 of the present invention comprises a pair of first side walls 11 and 12; a pair of second side walls 13 and 14; a pair of first top flaps 21 and 22 foldably connected to the pair of first side walls 11 and 12; a pair of second top flaps 23 and 24 foldably connected to the pair of second side walls 13 and 14; a pair of first bottom flaps 31 and 32 foldably connected to the pair of first side walls 11 and 12; a pair of second bottom flaps 33 and 34 foldably connected to the pair of second opposed side walls 13 and 14. The blank 100 further comprises a weakened area 52 formed at one of first side walls 11 and 12. The blank 100 may further comprises an end panel 16 connected to one side edge of the blank. A box of the present invention may be assembled from the blank of joining end panel 16 with an end side wall 14, thereby forming a rectangle box. For example, referring to FIG. 7, the blank 100 is folded upon itself and the end flap is adhesively attached to a side wall 14 at the opposite edge of the blank 100 to form a flattened, open-ended construction as shown in FIG. 11. The box may be stored and shipped in this flat pack condition before being used. At the point of use, the flattened box is opened up or expanded into the tubular configuration and set up to a box.

Descriptions of a weakened area illustrated with respect to a box of the present invention apply to the blank of the present invention.

Figure 9:
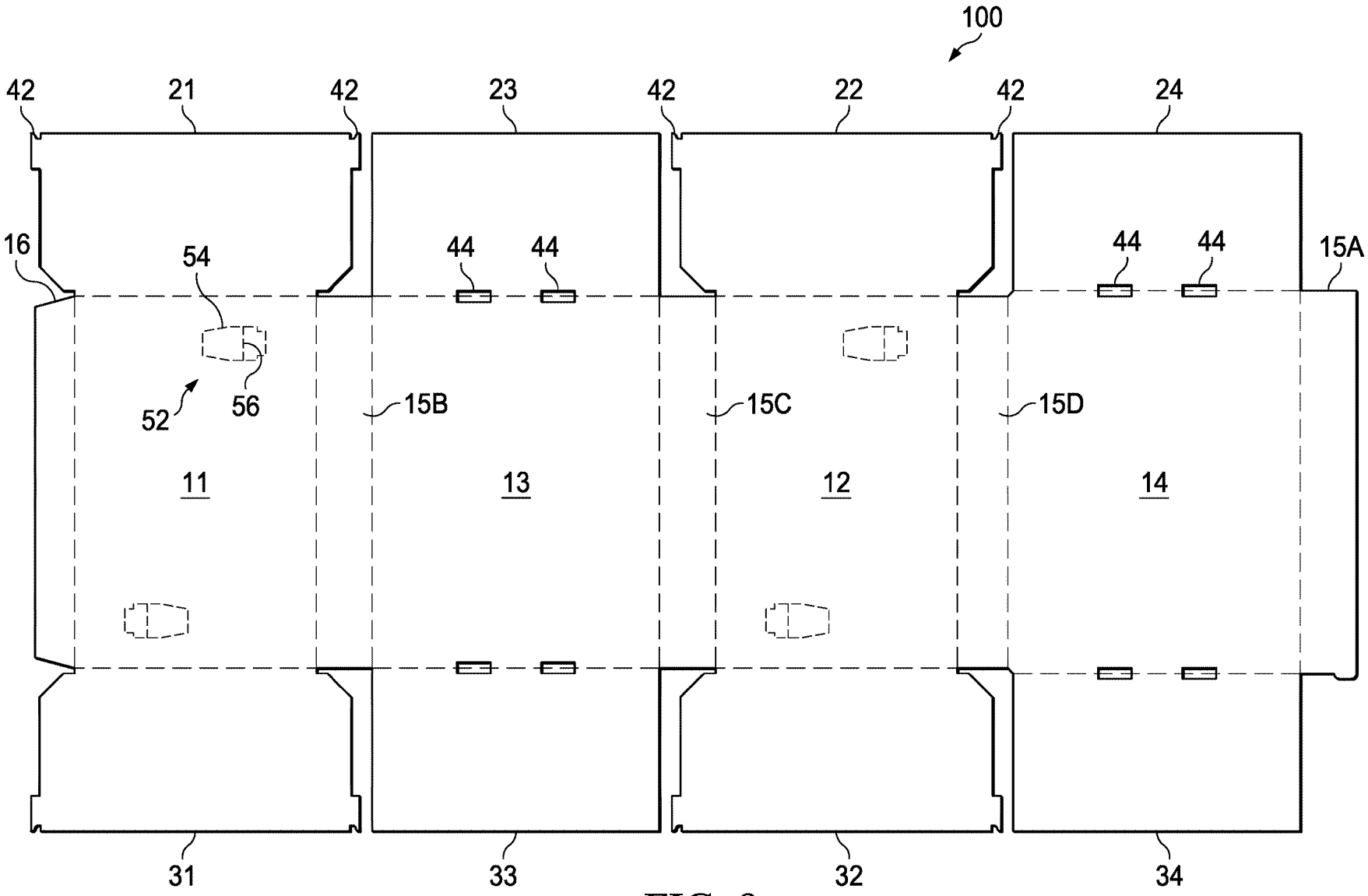
FIG. 9 is a plan view of another blank of the present invention used to form the box in FIG. 5.

The blank of the present invention may further comprise a corner panel between two adjacent side walls. Referring to FIGS. 8 and 9, blanks to form the box 10 in FIG. 5, a blank 100 of the present invention may comprise a pair of first opposed side walls 11 and 12; a pair of second opposed side walls 13 and 14; a pair of first opposed top flaps 21 and 22 foldably connected to the pair of first opposed side walls 11 and 12; a pair of second opposed top flaps 23 and 24 foldably connected to the pair of second opposed side walls 13 and 14; a pair of first opposed bottom flaps 31 and 32 foldably connected to the pair of first opposed side walls 11 and 12; a pair of second opposed bottom flaps 33 and 34 foldably connected to the pair of second opposed side walls 13 and 14; and at least one of corner panels, 15A, 15B, 15C and 15D between side walls 11, 12, 13 and 14. A box may be assembled from the blank by joining end panel 16 with an end side wall 14 (FIG. 8) or by joining end panel 16 with corner panel 15A (FIG. 9) forming a flatten box. The blank 100 may have four corner panels 15A, 15B, 15C and 15D so that a box formed from the blank 100 is an octagonal box having a pair of first opposed side walls, a pair of second opposed side walls and four interposed diagonal corner panels.

The blank 100 of the present invention may further comprise a protrusion on a side edge of a first top flap and a slot at a line joining a second top flap and a side wall in such a way that the protrusion and the slot are engaged with each other when the blank is set up to a box. Descriptions of a protrusion and a slot illustrated with respect to a box of the present invention apply to the blank of the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A box of one or more absorbent articles, the box having a top, a bottom, a longitudinal direction and a transversal direction, and comprising:

a pair of first opposed side walls;

a pair of second opposed side walls;

a pair of first opposed top flaps foldably connected to the pair of first opposed side walls;

a pair of second opposed top flaps foldably connected to the pair of second opposed side walls;

a pair of first opposed bottom flaps foldably connected to the pair of first opposed side walls;

a pair of second opposed bottom flaps foldably connected to the pair of second opposed side walls;

a weakened area defined by an external weakened line at one of the first opposed side walls; the weakened area comprising a first section and a second section divided by an internal weakened line, wherein the first section comprises a first section outboard edge, and wherein the second section comprises a second section inboard edge; and an adhesive tape having a tape width and a tape end, and covering adjacent edges of the second opposed top flaps to seal the top of the box;

wherein the adhesive tape extends along a portion of the one of the first opposed side walls so that the adhesive tape covers part of the second section so as not to cover the internal weakened line;

wherein the internal weakened line is no shorter than a width of the first section;

wherein the internal weakened line is longer than the second section inboard edge;

wherein the internal weakened line is a straight line and is angled in a transversal direction in such a way that an angle a determined by an imaginary line parallel to the transversal direction of the box and the internal weakened line is greater than 0° and less than 90°; and wherein the weakened area does not extend fully across the adhesive tape in the width direction of the adhesive tape.

2. The box of claim 1, comprising one corner panel between two adjacent side walls.

3. The box of claim 1, wherein the external weakened line comprises perforations, and wherein the internal weakened line comprises a perforation having a length different than the length of perforations of the external weakened line.

4. The box of claim 3, wherein the external weakened line comprises perforations, and wherein the internal weakened line comprises a perforation having a length longer than the length of perforations of the external weakened line.

5. The box of claim 1, wherein the internal weakened line extends along the longitudinal direction of the box.

6. The box of claim 1, wherein a length of the adhesive tape overlapping the weakened area is shorter than a length of the internal weakened line.

7. The box of claim 1, wherein a length from a bottom-most point of the weakened area to the end of the adhesive tape is no longer than about 50 mm.

8. The box of claim 1, wherein the first section comprises a non-linear external weakened line.

9. The box of claim 1, comprising at least one handle provided in at least one of the side walls and top flaps.

10. The box of claim 9, wherein the handle is a cut-out section configured to enable sliding one or more fingers of a hand through the cut-out section to grip the package.

11. The box of claim 1, comprising one or more indicia indicating the presence of the weakened area.

12. The box of claim 1, wherein the weakened area comprises an indicia to guide how to use the weakened area.

13. The box of claim 1, wherein the first section and the second section have different components from each other of one or more of colors, text, icons and combinations thereof.

14. The box of claim 1, comprising a protrusion on a side edge of one of the first opposed top flaps, and a slot at a line joining one of the second opposed top flaps and one side wall, wherein the protrusion engages with the slot.

15. The box of claim 14, wherein the protrusion comprises a hook-shaped end.

16. The box of claim 14, wherein the protrusion has a protrusion length and the slot has a slot length in the range of about 90% to about 110% of the protrusion length.

17. The box of claim 14, wherein the slot has a width of about 140% to about 180% of a thickness of the protrusion.

18. The box of claim 1, wherein the internal weakened line is shorter than the first section outboard edge.

19. A box of one or more absorbent articles, the box having a top, a bottom, a longitudinal direction and a transversal direction, and comprising:

a pair of first opposed side walls;

a pair of second opposed side walls;

a pair of first opposed top flaps foldably connected to the pair of first opposed side walls;

a pair of second opposed top flaps foldably connected to the pair of second opposed side walls;

a pair of first opposed bottom flaps foldably connected to the pair of first opposed side walls;

a pair of second opposed bottom flaps foldably connected to the pair of second opposed side walls;

a weakened area defined by an external weakened line at a first of the first opposed side walls; the weakened area comprising a first section and a second section divided by an internal weakened line, wherein the first section comprises a first section outboard edge, and wherein the second section comprises a second section inboard edge;

a handle disposed in a second of the first opposed side walls; and an adhesive tape having a tape width and a tape end, and covering adjacent edges of the second opposed top flaps and configured to seal the top of the box;

wherein the adhesive tape extends along a portion of the first of the first opposed side walls so that the adhesive tape covers part of the second section of the weakened area so as not to cover the internal weakened line;

wherein the internal weakened line is no shorter than a width of the first section;

wherein the internal weakened line is longer than the second section inboard edge; and wherein the internal weakened line is a straight line and is angled in a transversal direction in such a way that an angle a determined by an imaginary line parallel to the transversal direction of the box and the internal weakened line is greater than 0° and less than 90° .

* * * * *